United States Patent [19]

Tontarelli

[11] Patent Number: 4,511,057

[45] Date of Patent: Apr. 16, 1985

[54] CAP FOR THE TEMPORARY HERMETIC CLOSURE OF CYLINDRICAL TIN CANS WITH PULL-OFF OPENING TAB

[76] Inventor: Sergio Tontarelli, Via Mordini Ciriaco, 37, Castelfidardo (AN), Italy

[21] Appl. No.: 559,280

[22] Filed: Dec. 8, 1983

[30] Foreign Application Priority Data

Dec. 15, 1982 [IT] Italy ..... 17929 A/82

[51] Int. Cl.[3] ..... B65D 41/16; B65D 41/18

[52] U.S. Cl. ..... 220/306; 220/314; 220/243

[58] Field of Search ..... 220/314, 306, 323, 859 P, 220/243; 222/566, 570

[56] References Cited

U.S. PATENT DOCUMENTS 4,387,826 6/1983 Heull ..... 220/314

*Primary Examiner*—George T. Hall

*Attorney, Agent, or Firm*—Leonard Bloom

[57] ABSTRACT

The instant invention relates to a cap for the temporary closure of cans, often called "tin cans", which are currently one of the most used forms of containers for the distribution of drinks in general. It is essentially a rigid piece of moulded plastic, of an irregular shape, with four rigid hooked teeth protruding from its underside. Said teeth are all found on the same circumference, equal to the circular rim of the tin can, over and under which the aforesaid teeth hook. This hooking action may occur with a snap in that two of the four aforesaid rigid teeth are situated underneath a rigid bracket attached to the aforesaid rigid piece by two small, thin flexible bridges.

7 Claims, 5 Drawing Figures

SEZ. A-A

CAP FOR THE TEMPORARY HERMETIC CLOSURE OF CYLINDRICAL TIN CANS WITH PULL-OFF OPENING TAB

This application for industrial utility patent has for its object a cap for the temporary closure of cans, often called "tin cans", which are currently one of the most used forms of containers for the distribution of drinks in general.

These containers are of a cylindrical shape and may be opened by pulling a tab found on the top of the can which tears along its edges leaving a hole in the can top similar to a small circular sector with rounded corners.

These "tin cans" have standard dimensions, with a fairly high contents level of about thirty-three centiliters, which often means that the drink is not consumed all at once but sipped or left to be drunk later.

This often gives rise to the inconvenience of not being able to temporary close the tin properly both to avoid spilling the liquid when the tin cannot be placed on a flat surface, for example, during a car journey, and to prevent the drink, which is almost always fizzy, from losing its effervesence.

The caps currently in use for this kind of closure are rather complex in structure, expensive to manufacture and functionally lacking.

One already familiar type, for instance, consists of an expanding cap comprising a plastic stopper which is placed into the opening on the tin can, and an eccentric device which allows the stopper to give and hermetically close the tin.

This cap, in effect, is complicated and expensive to construct so much so that a simpler and cheaper model has been proposed. This model comprises an ordinary circular lid in a soft flexible plastic which is fitted over the top of the tin. It is provided with an internal stopper protruding from the underside of the lid, which is forced into the hole left by the torn away tab.

This model although economical still has one big drawback in that often the gas inside the tin is sufficient to push off the lid since, as already explained, said lid is merely pressed over the upper part of the tin can.

The aim of the herein described invention is to create a cap ideal for the closure of said tin cans. A cap which is simple, economical and truly functional.

The features of the cap according to this invention will become apparent as this specification proceeds with reference to and as indicated by the accompanying drawings which illustrate only one embodiment of the invention wherein.

Figure 3:
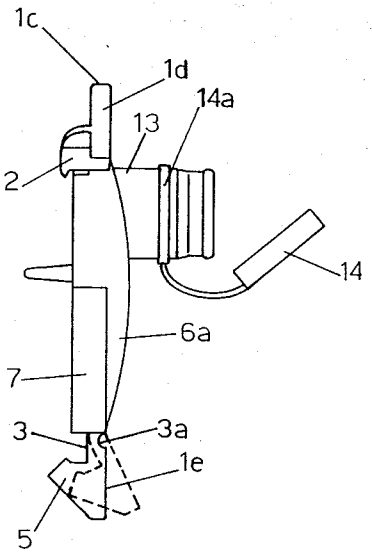
FIG. 3 is a side view from left to right of FIG. 1.
Figure 1:
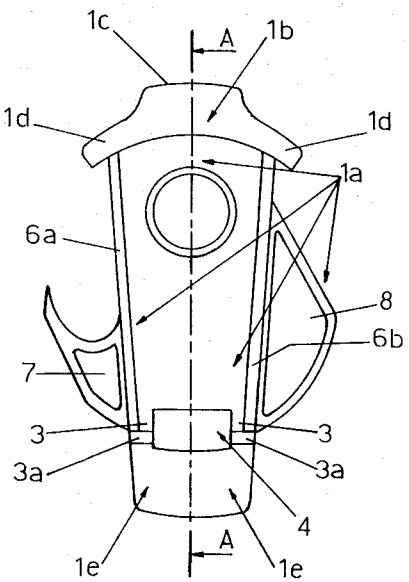
FIG. 1 is a top view of the cap according to the invention.
Figure 2:
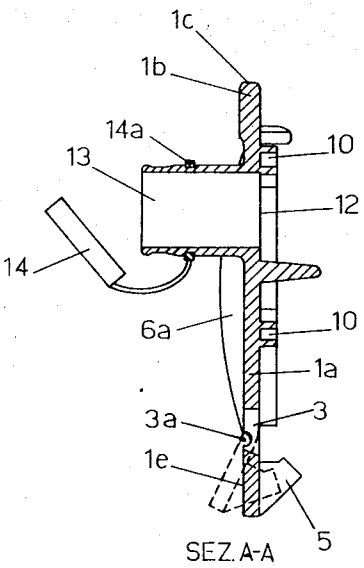
FIG. 2 is the section A—A of FIG. 1.
Figure 5:
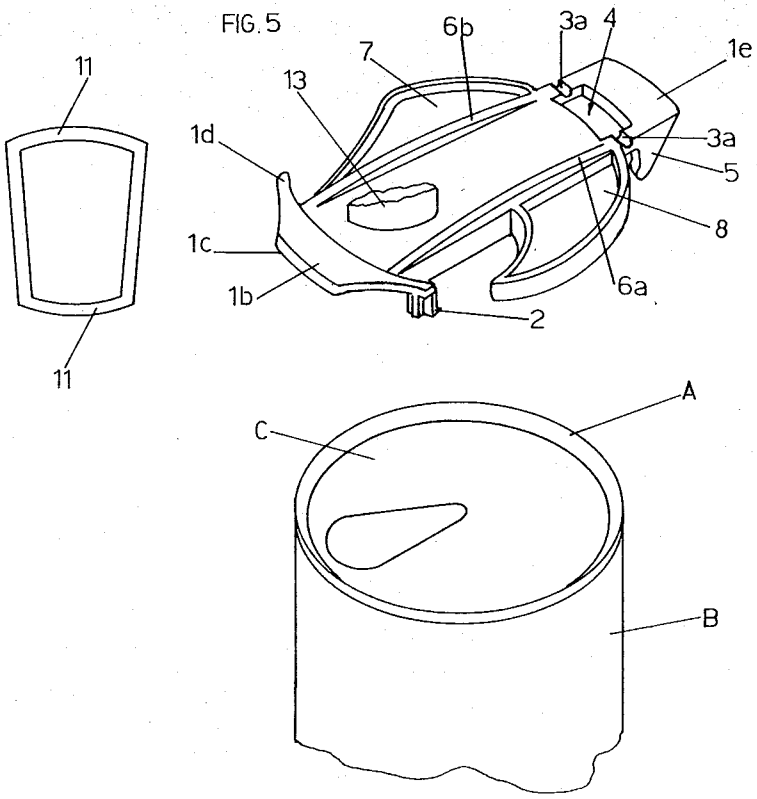
FIG. 5 is a perspective representation of the cap according to the invention.
Figure 4:
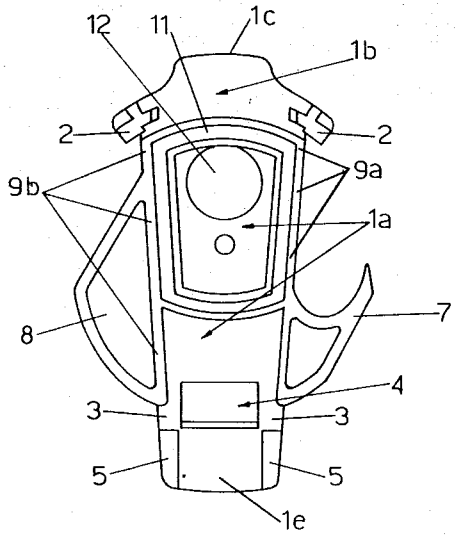
FIG. 4 is a bottom view of the cap according to the invention.

With reference to the aforesaid figures said invention comprises a piece of moulded plastic of an irregular shape, having a thickness and body such that it may be considered absolutely rigid, unable to be deformed under strain whether longitudinal or transversal.

In order to get a clearer idea of such an irregularly shaped and articulated piece we shall imagine that it can be dismantled.

There can thus be seen a fairly large central body (1*a*) from which two diametrically opposed parts jut.

Number (1*b*) indicates the curved head-part, similar to a common coathanger, characterized by a central tongue (1*c*) and by two curved projections (1*d*) protruding laterally, under which are found two hooked teeth (2) which are provided to clip under the circular rim (A) of the tin can (B).

Diametrically opposed to the head-part (1*b*) is a small, almost rectangular bracket (1*e*) attached to the central body (1*a*) by only two small thin bridges (3), separated by a square hole (4).

Two transversal grooves (3*a*) are found on these bridges which facilitate their flexing action.

From the underside of said bracket (1*e*) two hooked teeth (5) protrude which clip under the circular rim (A) of the tin can (B) in the same way as the other pair do, since these teeth are all found on the same circumference with exactly the same external diameter as that of the circular rim (A) of the tin can (B).

It should be emphasized that each of the hooked teeth is so solidly fixed as to be considered a fixed bracket, completely rigid.

This has been specifically mentioned in order to clarify and indicate without any shade of doubt what elastic deformation permits the hooking of the cap onto the tin with a snapping action.

The hooking action of the four aforesaid teeth occurs when the rigid bracket (1*e*) is rotated with respect to the rigid body (1*a*) following the curving and flexing of the small, narrow bridges (3) following a bending stress.

Once the cap has been positioned over the tin can, pressure applied near the square hole (4) deforms the small bridges (3) which curve causing the two pairs of diametrically opposed rigid teeth (2) and (5) to open out and extend in such a way that they snap over the circular rim (A) of the tin and hook underneath.

This hooking action can be carried out by the two pairs of aforesaid teeth either simultaneously or successively.

In order to unhook the cap upward pressure must be applied on the rigid bracket (1*e*) so that the small bridges (3) bend releasing the rigid teeth (5) from under the circular rim (A) of the tin (B).

Returning now to the structural description of the cap according to the instant invention, it can be seen that the central body (1*a*) is crossed on its upper surface by two stiffening ribs (6*a*) and (6*b*), which gradually taper in thickness from a central point terminating at the small bridges (3), at one end, and at the head-part the other end.

The central part (1*a*), according to our purely hypothetical dismantling of the invention, also comprises a beak-shaped projection (7), flat and with a flanged edge, located on the outer side of the aforesaid rib (6*a*). With the use of this projection it is possible to hook the ring which pulls the tab off the top (C) of the tin can (B).

In this case the tap must be held tightly on both sides for which purpose there has been provided a flanged wing (8) on the outer side of the rib (6*b*), on the opposite side of the beak-shaped projection (7).

The central body (1*a*) is also crossed, on its under side, by two ribs (9*a*) and (9*b*) corresponding to the upper ribs (6*a*) and (6*b*). These ribs (9*a*) and (9*b*) are of an appropriate length and thickness so as to fit exactly inside the circular rim (A) of the tin can, whilst the pairs of rigid teeth (2) and (5) hook under the rim on the outer side.

There can also be found on the under surface of the cap an almost trapezoidal groove (10) into which a rubber seal (11) of the same shape is pushed and held. Said seal is compressed under the cap against the top (C) of the tin can around the rim of the opening left by the torn away tab.

According to another preferred embodiment of this cap, the area enclosed by the aforesaid rubber seal (11) may be found a mouthpiece (12) for a spout (13) projecting from the central body (1*a*), over which is fitted the neck ring (14*a*) of a push-over plastic top (14).

What is claimed is:

1. Cap for the temporary hermetical closure of cans with a pull-off opening tab, characterized by an irregularly shaped, molded plastic piece, where there can be found a fairly large central body from which jut two diametrically opposed parts; a head-part with two side curved projections, and the other part consisting of an almost rectangular bracket attached to the central body by two thin, narrow bridges having flexing action under pressure accentuated by means of two transversal grooves provided oppositely in the center of the same, and from the curved projections which jut laterally from the said head-part, protrude two hooked teeth completely rigid given their thickness and their solid fixing in said head-part.

2. Cap for the temporary hermetical closure of cans with pull-off opening tab according to claim 1, characterized by the fact that from the underside of said bracket two hooked teeth protrude laterally, said teeth completely rigid given their thickness and their solid fixing in said bracket.

3. Cap for the temporary hermetical closure of cans with pull-off opening tab, according to claim 2, characterized by the fact that said hooked teeth are all round on the same circumference equal to the rim of the can, since said rigid teeth hook over and under said rim.

4. Cap for temporary hermetical closure of cans with pull-off opening tab, according to claim 3, characterized by the fact that the thickness of the cap and superficial ribbing which cross it are such that the central body, said head-part and said bracket are completely rigid structures unable to be bent either longitudinally or transversally.

5. Cap for the temporary hermetical closure of cans with a pull-off opening tab, characterized by an irregularly shaped, molded plastic piece, where there can be found a fairly large central body from which jut two diametrically opposed parts, a head-part with two side curved projections, and the other part consisting of an almost rectangular bracket attached to the central body by two thin, narrow bridges having flexing action under pressure accentuated by means of two transversal grooves provided oppositely in the center of the same, and said central body is crossed on its underside by two longitudinal ribs, said ribs are of an appropriate length and thickness so as to fit exactly inside the rim of the can, while associated rigid teeth hook over and under the rim on the outer side.

6. Cap for the temporary hermetical closure of cans with a pull-off opening tab, characterized by an irregularly shaped, molded plastic piece, where there can be found a fairly large central body from which jut two diametrically opposed parts, a head-part with two side curved projections, and the other part consisting of an almost rectangular bracket attached to the central body by two thin, narrow bridges having flexing action under pressure accentuated by means of two transversal grooves provided oppositely in the center of the same, and said central body also comprises a side beak-shaped projection, with a flanged edge, which may be used to hook the ring and pull off the opening tab from the can.

7. Cap for the temporary hermetical closure of cans with a pull-off opening tab, characterized by an irregularly shaped, molded plastic piece, where there can be found a fairly large central body from which jut two diametrically opposed parts, a head-part with two side curved projections, and the other part consisting of an almost rectangular bracket attached to the central body by two thin, narrow bridges having flexing action under pressure accentuated by means of two transversal grooves provided oppositely in the center of the same, and said central body also comprises a side flanged wing located on the opposite side of the aforesaid beak-shaped projection, said wing facilitates the holding of the cap during the hooking and pulling action carried out by the aforesaid projection.

* * * * *